US005488783A

United States Patent [19]

Parkinson et al.

[11] Patent Number: 5,488,783

[45] Date of Patent: Feb. 6, 1996

[54] DIFFUSER FOR A HAIR DRYER

[75] Inventors: James W. Parkinson, North Humberside, United Kingdom; Dieter Liebenthal, Maintal, Germany

[73] Assignee: Braun Aktiengesellschaft, Frankfurt, Germany

[21] Appl. No.: 244,120

[22] PCT Filed: Nov. 16, 1992

[86] PCT No.: PCT/EP92/02640

§ 371 Date: May 20, 1994

§ 102(e) Date: May 20, 1994

[87] PCT Pub. No.: WO93/09693

PCT Pub. Date: May 27, 1993

[30] Foreign Application Priority Data

Nov. 20, 1991 [GB] United Kingdom ..... 9124609

[51] Int. Cl.[6] ..... A45D 20/48

[52] U.S. Cl. ..... 34/98; 34/283; 392/385

[58] Field of Search ..... 34/96, 97, 98, 34/99, 283; 392/380, 381, 382, 383, 384, 385

[56] References Cited

U.S. PATENT DOCUMENTS

| | | | |
|---|---|---|---|
| D. 354,152 | 1/1995 | Mathews | D28/18 |
| 2,626,618 | 1/1953 | Collison . | |
| 3,840,030 | 10/1974 | Baker | 132/9 |
| 4,759,135 | 7/1988 | Scivoletto | 34/97 |
| 5,275,339 | 1/1994 | Andis et al. | 34/97 |

FOREIGN PATENT DOCUMENTS

| | | | |
|---|---|---|---|
| 0439781A1 | 12/1990 | European Pat. Off. . | |
| 1479564 | 5/1967 | France . | |
| 2281736 | 3/1976 | France | A45D 20/50 |
| 2332720 | 6/1977 | France | A45D 20/50 |
| 2446615 | 8/1980 | France . | |
| 396845 | 8/1933 | United Kingdom . | |
| WO91/08690 | 6/1991 | WIPO | 392/380 |

*Primary Examiner*—Henry A. Bennet
*Assistant Examiner*—Susanne C. Tinker
*Attorney, Agent, or Firm*—Edward S. Podszus

[57] ABSTRACT

The invention is directed to a diffuser for a hair dryer comprising a diffuser body which is adapted to be secured to the nozzle of the hair dryer and includes a plurality of hair pickup elements (9, 10, 11) extending away from the diffuser body. At least one of the hair pickup elements (9, 10) is movably arranged on the diffuser body.

32 Claims, 7 Drawing Sheets

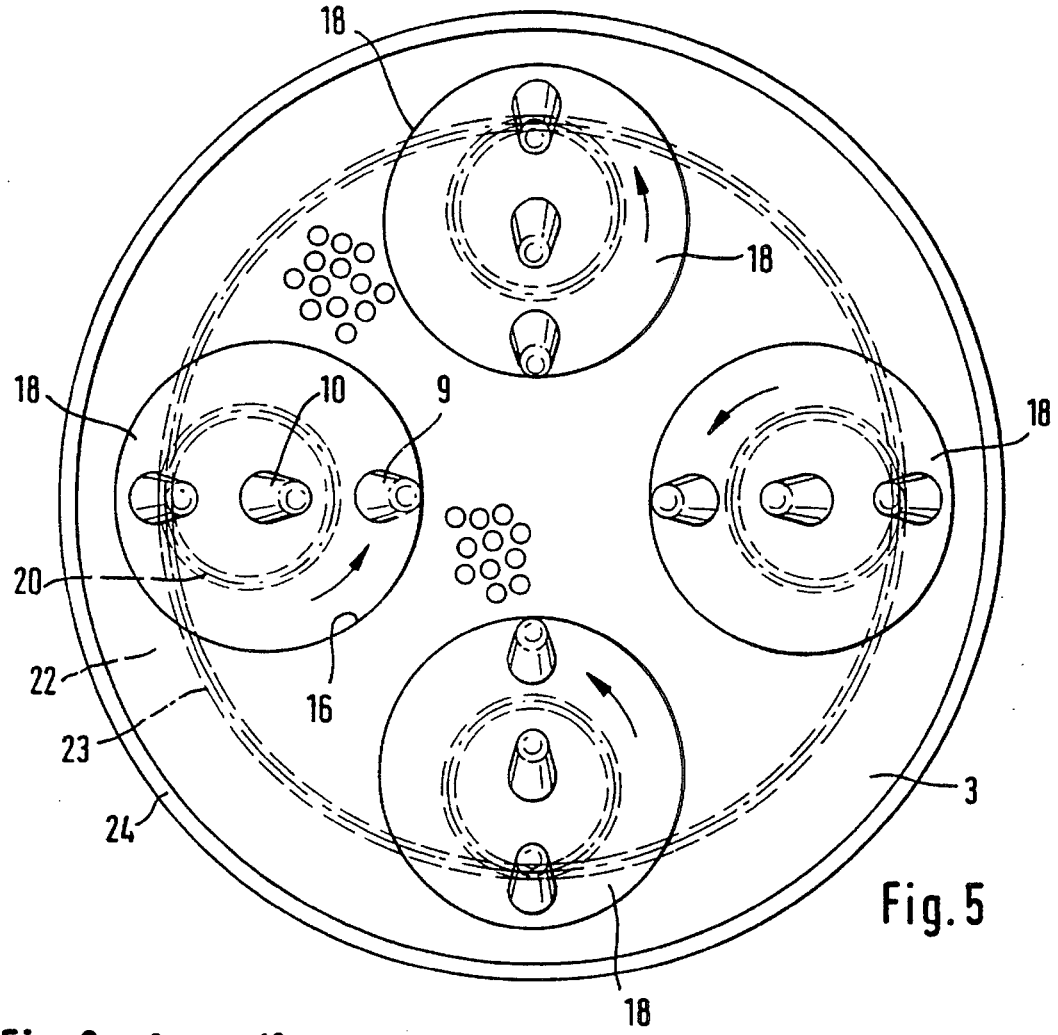
Fig. 5
Fig. 6
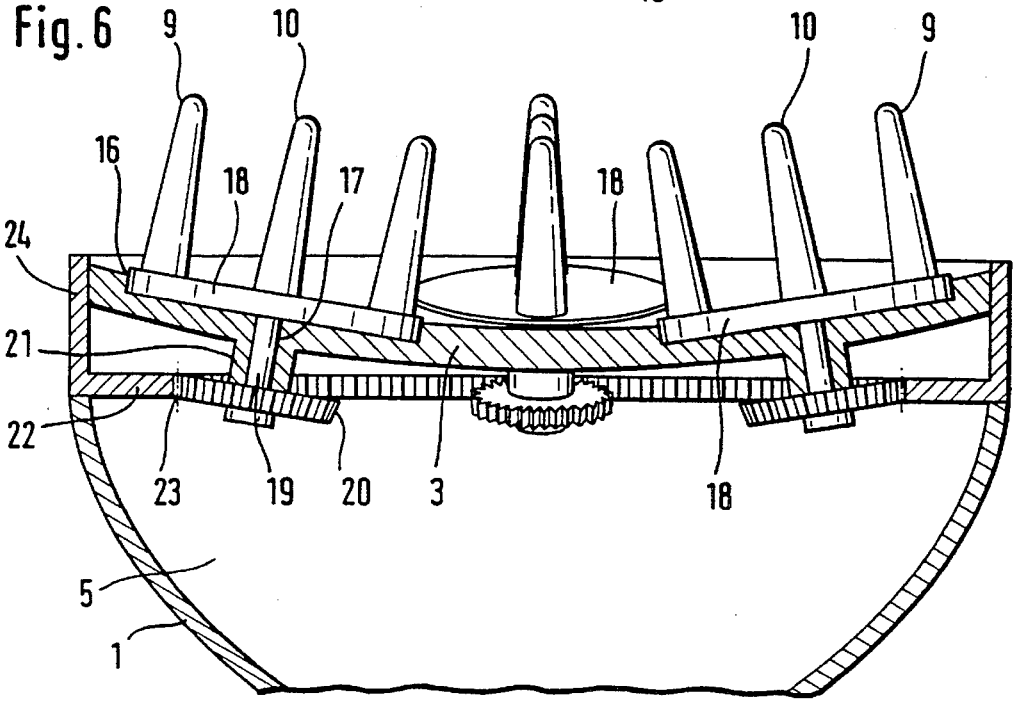

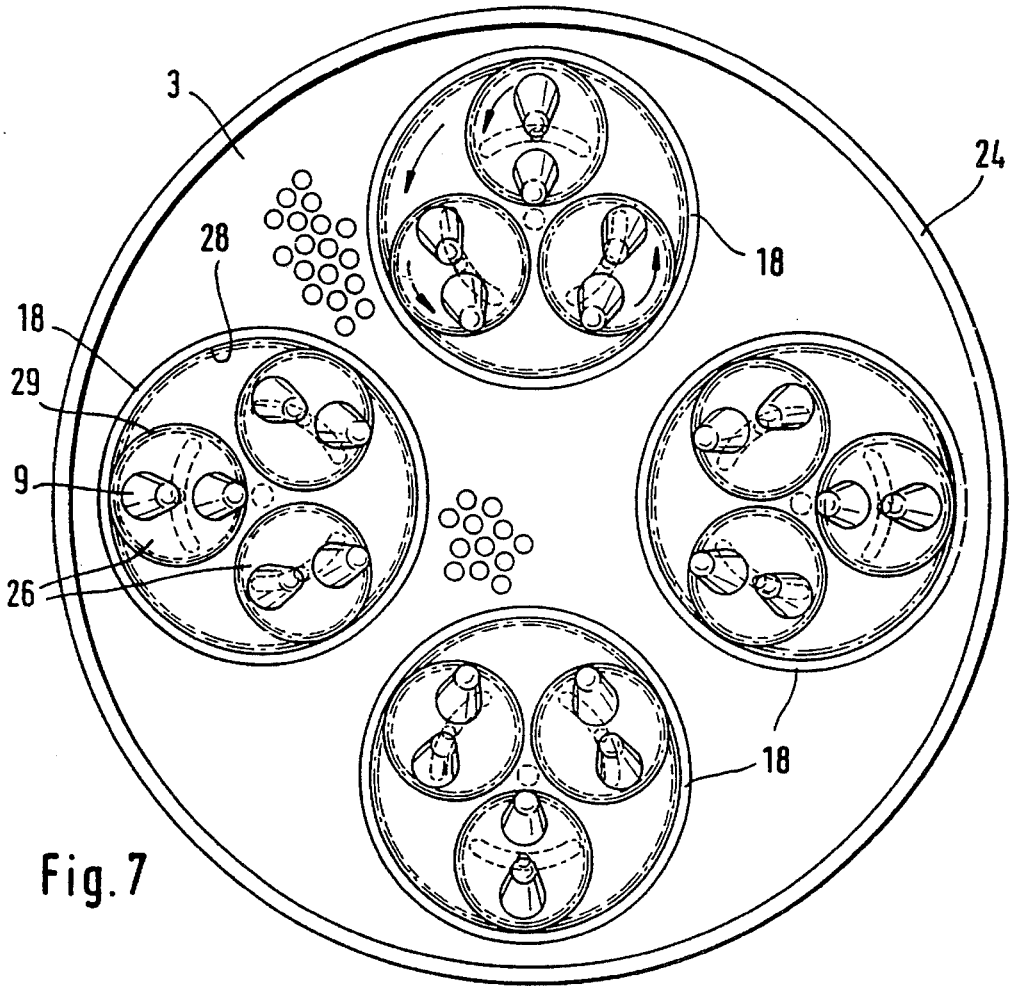
Fig. 7
Fig. 8
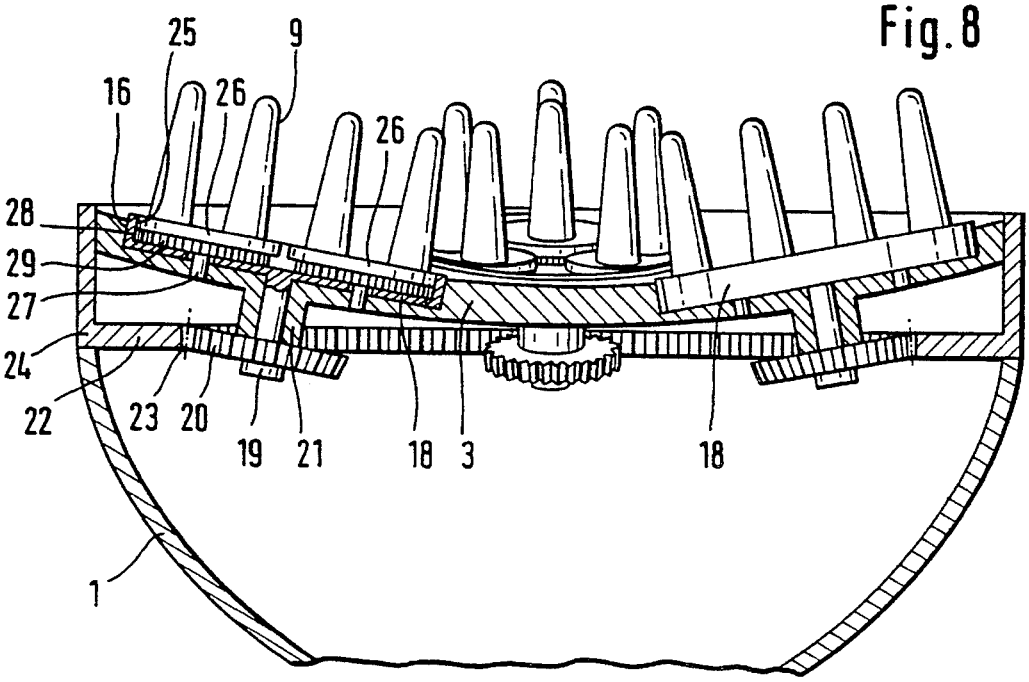

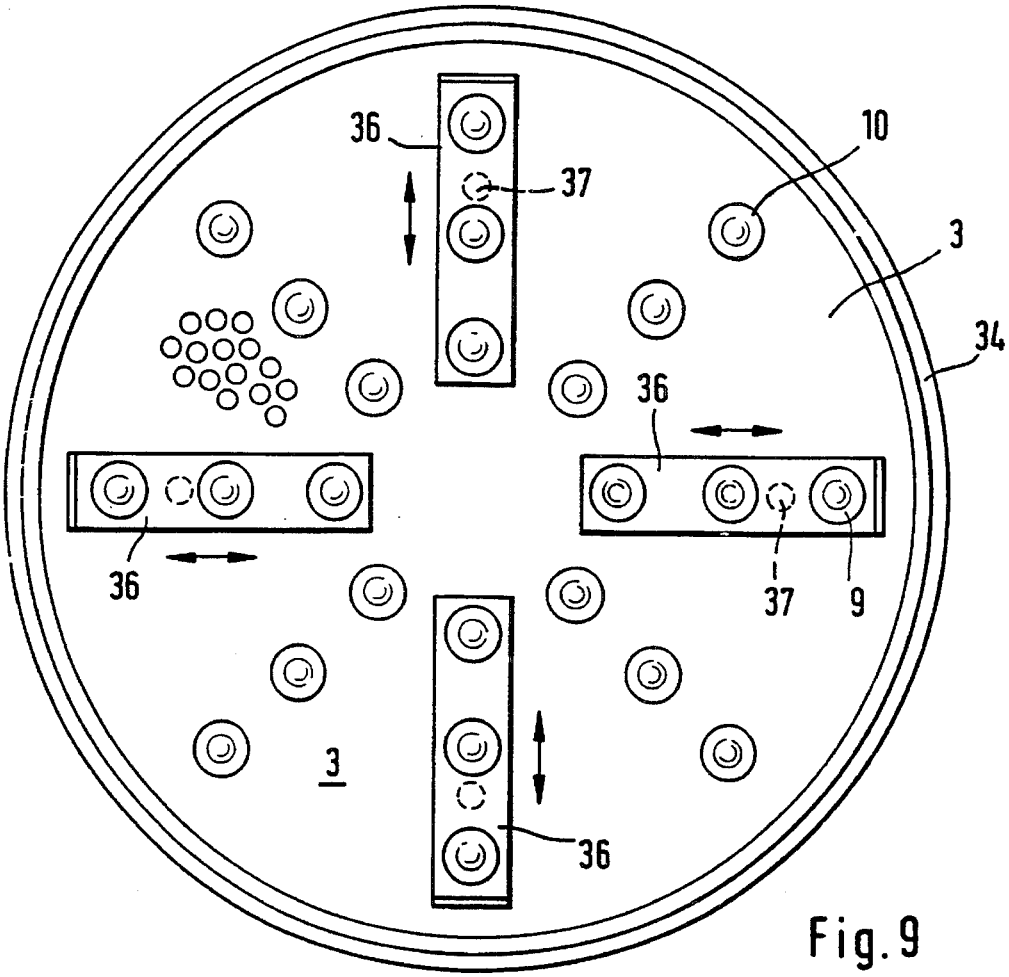
Fig. 9
Fig. 10
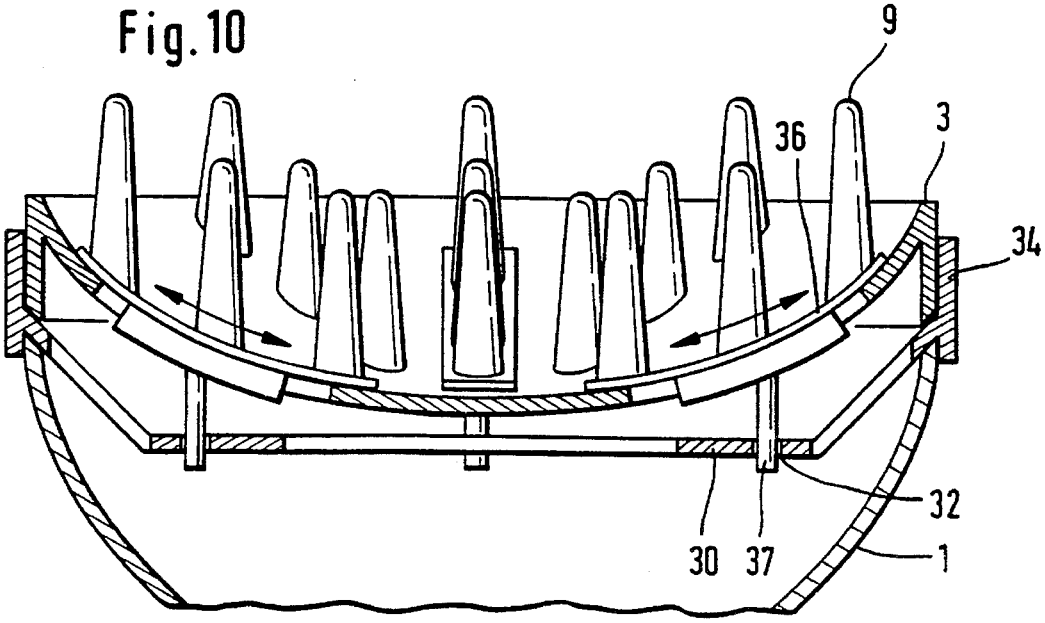

DIFFUSER FOR A HAIR DRYER

This invention relates to a diffuser suitable for use with hair dryers.

The jet of air discharged from a hair dryer is usually strong and unfocused so that wet hair can be dried quickly and efficiently. Some hair dryers do have the facility to switch the speed of the jet of air between fast and slow settings, and the temperature of the jet of air between cool, warm and hot settings. Nevertheless, not all hair styles can be dried satisfactorily using such a conventional hair dryer. Therefore, a range of devices such as concentrators have been devised for attachment to the nozzle of a hair dryer. One such attachment is the diffuser enabling the velocity of the discharged jet of air to be reduced.

A diffuser generally comprises a bowl-shaped outer shell the base of which has an aperture therein which leads to a tubular adapter to facilitate attachment to the nozzle of a hair dryer. The open end of the bowl-shaped outer shell is closed by a further bowl-shaped inner shell of a radius smaller than that of the outer shell so that an enclosed space is defined between the facing surfaces of the inner and outer shells. A plurality of in particular hollow and in particular open-ended fingers extend from the outer surface of the inner shell, and in use air from the hair dryer is expelled through the open-ended fingers of the diffuser.

The effect of a diffuser is to diffuse the jet of air from the nozzle of a hair dryer through a plurality of apertures of relatively small diameter. This has the effect of both slowing the flow of air and, where applicable, of cooling it. This gives a very much more gentle drying action than does a hair dryer without the diffuser fitted. The hair is not disturbed by the air expelled from the apertures in the ends of the fingers. This makes the diffuser particularly suitable for drying naturally curly hair as well as permed and waved hair.

A diffuser of this type is known, for example, from applicant's printed specification EP 0 439 781 A1. This known diffuser is comprised of a diffuser dome flaring outwardly in the shape of a funnel and a diffuser screen. On the outer surface of the diffuser screen, a plurality of finger spacers are provided having outlet apertures in their ends, thereby enabling the discharged air to reach also sections of hair close to the scalp and improving the aeration of the hair. However, for curling or waving in particular naturally straight hair, conventional diffusers are not particularly well suited or are complicated to manipulate.

It is an object of the present invention to provide a diffuser that allows ready styling, in particular curling or waving, of hair as it is dried.

This object is essentially accomplished by a diffuser for a hair dryer comprising a diffuser body which is adapted to be secured to a nozzle of the hair dryer and includes a plurality of hair pickup elements extending away from the diffuser body, wherein at least one of the hair pickup elements is movably arranged on the diffuser body. In use, the diffuser of the present invention is used in much the same way as a conventional diffuser. When hair enters the range of the hair pickup elements in use of the diffuser, these hair pickup elements will immerse in the hair, separating it into strands which will arrange themselves between the hair pickup elements. When the operator subsequently moves at least one of the hair pickup elements, those strands of hair that lie between the movable hair pickup element and the adjacent fixed hair pickup elements will be styled to form a curl, wave or some other shape while being exposed to the jet of air discharged from the diffuser. Thus the strands of hair caught between the hair pickup elements and styled on account of the displacement of at least one hair pickup element are dried by the diffuser of the present invention as a natural curl or wave is formed.

Advantageously, the hair pickup elements are moved relative to each other, causing the strands of hair that have entered the space between the hair pickup elements to form several waves or curls therebetween. As the hair dries a natural wave or curl can then be formed in the hair.

In a preferred embodiment of the invention, a first cluster of hair pickup elements is fixedly secured to the diffuser body while a second cluster of hair pickup elements is movable relative to the first cluster of hair pickup elements. This enables a larger section hair, that is, several strands of hair, to be formed at a time. During drying, when the one cluster of hair pickup elements is moved relative to the other cluster, the fixed hair pickup elements will retain single sections of the strands of hair, while at the same time the relatively movable hair pickup elements will form suitable waves or curls of these sections which are dried in this position. The size of the curls and waves is dependent on the extent of deflection of the movable elements.

In a further feature of the invention, all of the hair pickup elements are movable relative to each other, whereby the requisite extent of deflection of the hair pickup elements relative to each other is reduced, thereby allowing an improved manipulation of the diffuser.

By providing for circular movement Of at least one cluster of hair pickup elements relative to a central axis of the diffuser, a simple mechanical construction of the diffuser is ensured while affording ease of handling and obtaining very good hair styling results.

Advantageously, the diffuser body comprises an outer shell and an inner shell rotatably mounted and secured within the outer shell. This provides a straightforward and easy-to-manufacture construction of the diffuser body.

Because the inner shell is connected to the outer shell by a center piece, the inner shell being rotatable about the central axis of the diffuser and the center piece being secured to the outer shell through apertures in the inner shell, a straightforward construction for holding the inner shell captive is accomplished.

Advantageously, the outer shell, the inner shell and the center piece have an essentially circular circumference, the fastening apertures provided in the inner shell are arc-shaped slotted holes, and rotation of the inner shell is limited by the extent of said apertures.

Preferably, the hair pickup elements are arranged on the diffuser body in an annular pattern. As the inner shell is rotated, the ring of hair pickup elements disposed on this shell is displaced relative to the ring of hair pickup elements disposed on the center piece, as a result of which several strands of hair or a larger section of hair are styled at a time.

In an advantageous further feature, individual clusters of hair pickup elements are movable in a circle about different axes of rotation related to each cluster. This arrangement enables smaller sections of hair to be styled or curled independently of each other, producing special effects with regard to the hair dress.

In another feature of the invention, the inner shell includes depressions with apertures in which disks carrying hair pickup elements are rotatably arranged. Constructing the inner shell in this manner serves to position the disks. The provision of additional disks allows a more individual styling of hair, and the shape and number of waves or curls of individual hair sections can be varied within wide limits by the number of hair pickup elements disposed on the disks.

Preferably, the disks include an axle with a gear, the axles being guided by cylindrical sections encompassing the apertures. While these cylindrical sections perform an axial securing function for the disks, the gear provides the prerequisite for driving the disks.

In a further feature of the invention, a rotary device of an angular, for example, T- or L-shaped cross-section is disposed between a circumferential outer area of the shells, one leg thereof extending radially inwardly and having at its end internal teeth meshing with the gear in the interior of the diffuser. When the user operates this rotary device which is easy to manipulate, this motion will be transmitted to the gear and onwards to the disks, driving the disks and thereby moving the hair pickup elements relative to each other.

In another embodiment of the invention, further depressions are provided on the disks, said depressions rotatably receiving further disks carrying hair pickup elements. Owing to the plurality of individual disks carrying hair pickup elements, the user has the possibility to style, that is, to wave or curl, very small sections of hair individually. This configuration is thus particularly advantageous for a hair style involving many relatively small curls or waves.

Because the disks have a rim with internal teeth which are adapted to drive further disks provided with a toothed outer rim, a straightforward construction is accomplished for driving each disk individually. In a modification of this embodiment, the toothed outer rim may be omitted on some of the disks, so that their position is maintained unchanged, whilst the disks that do have a toothed outer rim are driven by the internal teeth.

In still another advantageous embodiment of the invention, individual clusters of hair pickup elements are movable radially to the central axis of the diffuser. This provides a favorable possibility of styling hair individually, differing completely from the circular movements of the hair pickup elements.

Advantageously, the diffuser body comprises an outer shell and an inner shell, and a disk is rotatably arranged between said shells, said disk having arc-shaped cutouts ascending towards the edge of the disk and descending at the other end, and a rim configured as an actuating ring. When the user rotates the actuating ring, the arc-shaped cutouts will cause the hair pickup elements to be moved in a radial direction.

Because the inner shell comprises radial guideways having apertures in which bars carrying hair pickup elements are received, with rows of hair pickup elements being fixedly secured in place between said bars, individual sections of hair will be held in position by the fixed hair pickup elements, while other sections of hair will be moved to another position relative to the fixed hair pickup elements by the hair pickup elements disposed on the bars, resulting necessarily in the formation of waves or curls. The guideways serve a lateral securing function to prevent the bars from being turned.

Advantageously, pins provided on the bars engage within the arc-shaped cutouts, and the bars are radially displaceable by means of the actuating ring. This simple cam control structure allows ease of motion of the hair pickup elements, in addition to providing accuracy with respect to the guiding of the bars during their radial movement.

In another advantageous embodiment of the invention, individual clusters of hair pickup elements are movable linearly and in relatively opposite directions, whereby other forms of wave or curl are produced. This reduces the requisite extent of linear deflection, improving at the same time manipulation of the diffuser. Advantageously, the outer circumference of the diffuser body is essentially rectangular, with the inner shell being formed with individual bars carrying hair pickup elements, as well as lateral guideways. As a result, larger sections of hair, which are determined by the respective bar width, are displaced in relatively opposite directions and dried in this position. The lateral displacement of the bars in opposite directions determines the size of the waves or curls.

By configuring the bars as toothed racks guided on an underside of the inner shell and meshing with at least one gear arranged therebetween, linear motion of the bars and their relative displacement is accomplished in a simple manner.

In a still further feature of the invention, the bars are movable by an adjusting means arranged on the outer shell and coupled to one of the bars. When this adjusting means is moved in a linear direction, this motion will be transmitted to said bar and onwards, by means of the rack and gear arrangement, to the other bars, causing these to move in a direction opposite to the driven bar. Another possibility of providing a drive mechanism is to configure the adjusting means as a small wheel and couple it to one of the gears disposed between the bars. As the wheel is turned, the gear will rotate, the rack and gear arrangement driving at the same time the bars in relatively opposite directions.

Advantageously, the hair pickup elements are configured as knobs, fingers, prongs, pins, or the like. The hair pickup elements may be specially formed to satisfy individual requests or requirements.

Because the hair pickup elements are hollow inside, having at their upper ends at least one aperture preferably laterally arranged, the exiting air is in a position to reach the region of the hair close to the scalp, fluffing out the hair more easily and drying it from the root end.

In a still further feature, the diffuser is integrally formed with the hair dryer, thereby producing a self-contained new hair-care appliance suited for special purposes.

Further features, advantages and application possibilities of the present invention will become apparent from the subsequent description of embodiments illustrated in more detail in the accompanying drawings. It will be understood that all features described and/or represented by illustration, whether taken alone or in any desired combination, constitute the subject-matter of the present invention, irrespective of their summarization in the claims and their back-references.

In the drawings,

FIG. 5 is a front view of a diffuser illustrating a third embodiment thereof, showing hair pickup elements movable in a circle about different central axes;

FIG. 6 is a schematic longitudinal sectional view of the diffuser of FIG. 5;

FIG. 7 is a front view of a diffuser illustrating a fourth embodiment thereof, showing hair pickup elements movable in a circle about different central axes;

FIG. 8 is a schematic longitudinal sectional view of the diffuser of FIG. 7;

FIG. 9 is a front view of a diffuser illustrating a fifth embodiment thereof, showing hair pickup elements movable radially to the central axis of the diffuser;

FIG. 10 is a schematic longitudinal sectional view of the diffuser of FIG. 9;

Figure 1:
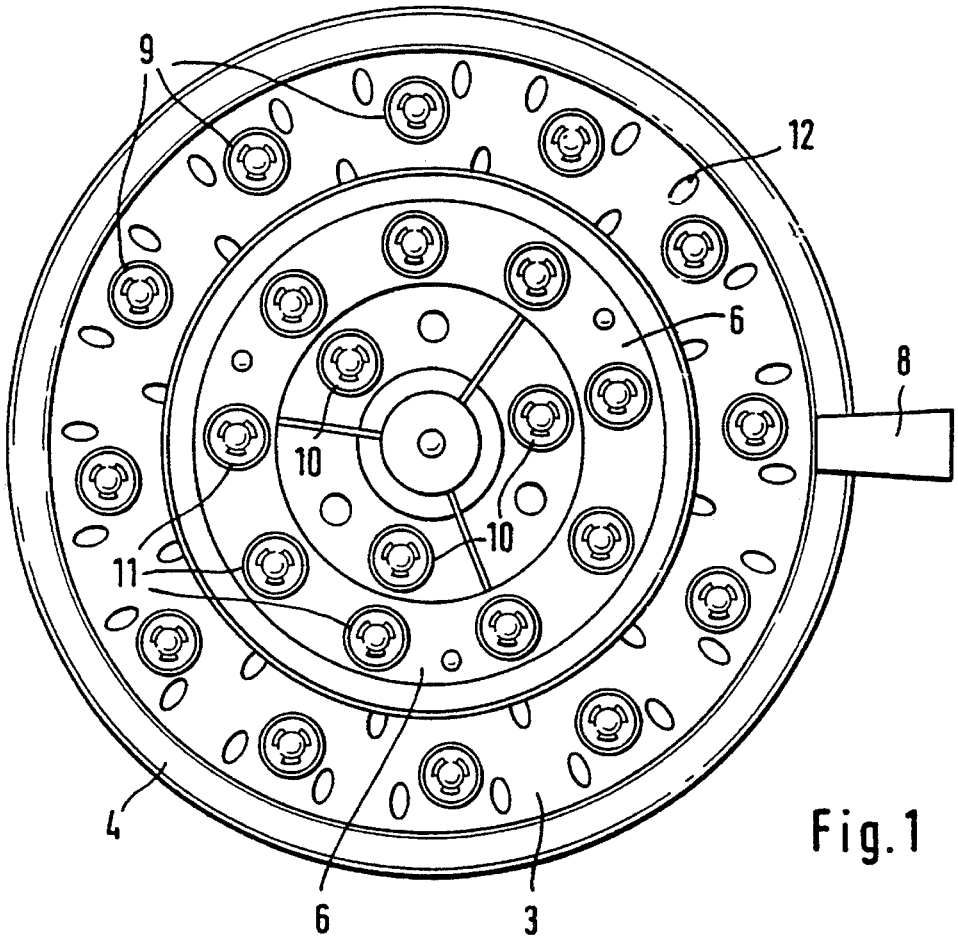
FIG. 1 is a front view of a diffuser illustrating a first embodiment thereof, showing hair pickup elements movable in a circle about the central axis of the diffuser.

Referring to the drawings, there is shown a diffuser suitable for attachment to a hair dryer. It will be understood, of course, that it is also possible and advantageous according to another embodiment to form the diffuser integrally with the hair dryer, so that a hair-care appliance operating as a self-contained unit with extended capabilities is obtained.

Figure 2:
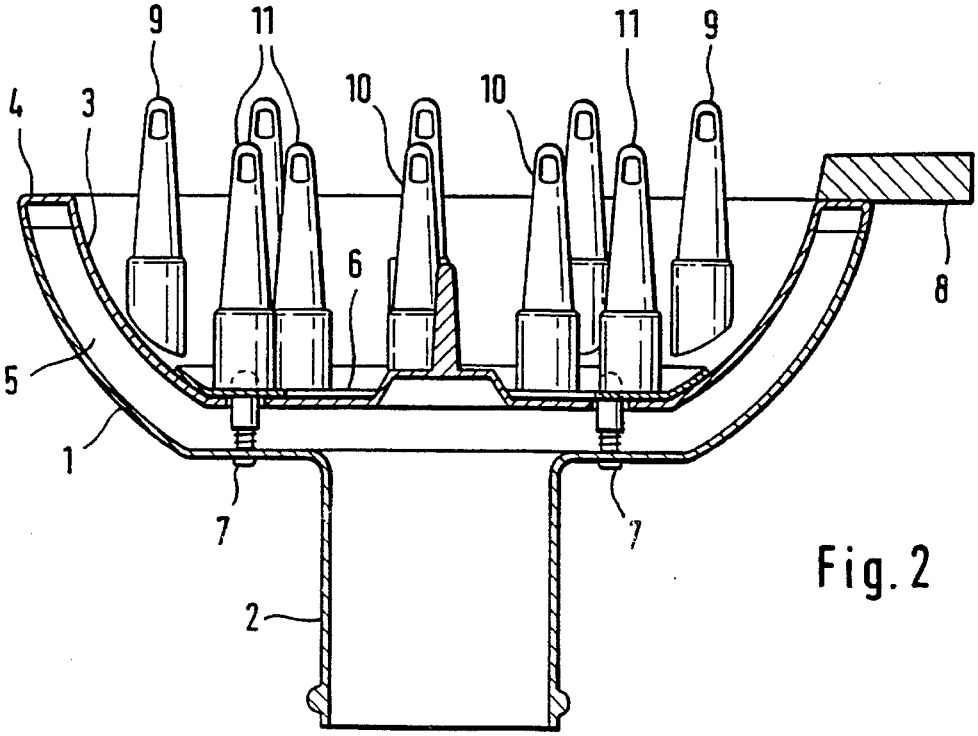
FIG. 2 is a schematic longitudinal sectional view of the diffuser of FIG. 1.

The diffuser of FIGS. 1 and 2 comprises a bowl-shaped outer shell 1 having an integrally formed tubular adapter 2 in the base portion thereof which facilitates attachment of the diffuser to the nozzle of a hair dryer. A similarly bowl-shaped inner shell 3 having an annular lip 4 around the periphery thereof is seated on the rim of the outer shell 1 and forms with the outer shell 1 an essentially enclosed cavity 5. This inner shell 3 is held in place within the outer shell 1 by an annular center piece 6 which is fixed in place by means of screws 7 which extend between the center piece 6 and the outer shell 1 through circumferentially extending apertures in the inner shell. A handle 8 extends from one side of the inner shell 3 and allows the inner shell 3 to be rotated about the central axis of the diffuser through the distance of the circumferentially extending slots therein.

The diameter of the center piece 6 is less than that of the inner shell 3, and a plurality of open-ended tubular hair pickup elements 9 extend from the exposed surface of the inner shell 3, forming a broken ring around the periphery of the center piece 6. Three further open-ended tubular hair pickup elements 10 extend from the center portion of the inner shell 3 through the aperture in the center piece 6. Yet more open-ended tubular hair pickup elements 11 extend from the center piece, forming a broken ring over the surface thereof.

All of the hair pickup elements 9, 10 and 11 open into the cavity 5 formed between the inner shell 3 and the outer shell 1. In use, air entering the adapter 2 from a hair dryer is expelled through the hair pickup elements 9, 10, 11 and further air discharge apertures 12 in the diffuser. However, when the inner shell 3 is rotated relative to the fixed center piece 6, this has the effect of displacing the hair pickup elements 9 and 10 circumferentially relative to the hair pickup elements 11. As a result of this action, any hair caught between the hair pickup elements 9, 10 and 11 is curled or waved. This curling or waving effect is fixed as the hair dries under the action of the diffuser.

In the diffuser shown in FIGS. 1 and 2, there are only three broken rings of hair pickup elements 9, 10 and 11, with two of the rings being rotatable relative to a fixed ring. Of course, further rings of hair pickup elements may be provided, the only criteria being that each rotatable ring alternates with a fixed ring. The air discharge apertures 12 in the inner shell 3 may be arranged both adjacent to the hair pickup elements 9 and between the hair pickup elements 10 and 11.

Figure 3:
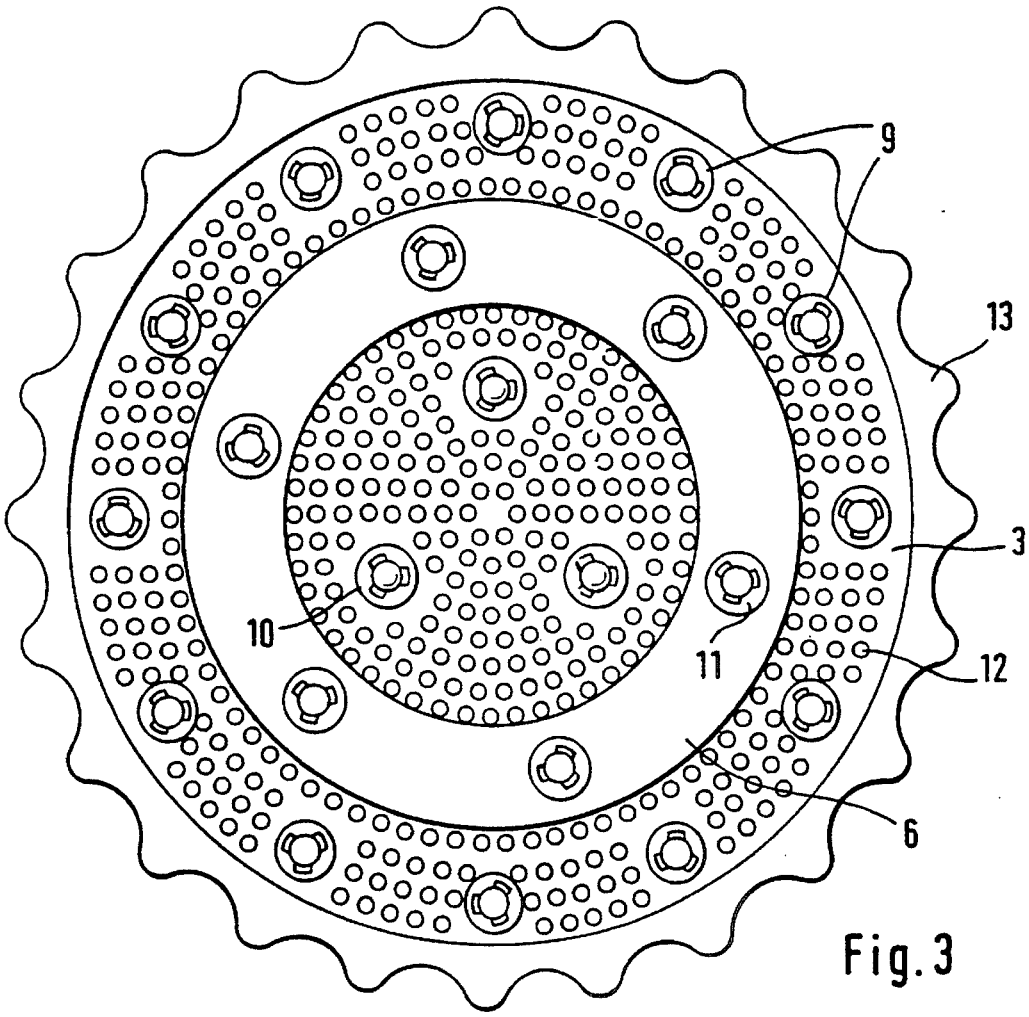
FIG. 3 is a front view of a diffuser illustrating a second embodiment thereof, showing hair pickup elements movable in a circle about the central axis of the diffuser.
Figure 4:
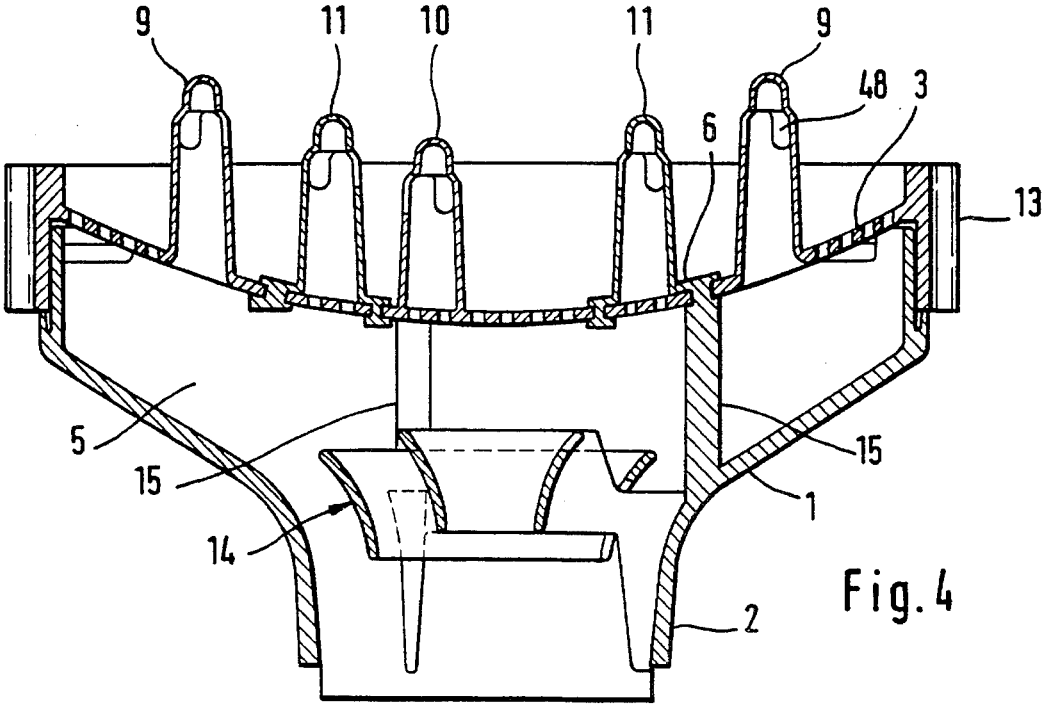
FIG. 4 is a schematic longitudinal sectional view of the diffuser of FIG. 3.

In a second embodiment of the diffuser according to FIGS. 3 and 4, the hair pickup elements 9, 10 and 11 are equally arranged on the inner shell 3, with the center piece 6 being fixedly connected to the outer shell 1 by means of fastening ribs 15. The fastening ribs 15 are arranged in arc-shaped apertures in the inner shell 3 which limit at the same time rotation of the inner shell 3. By means of the rotary ring 13 the inner shell 3 is moved, causing movement of the hair pickup elements 9 and 10 mounted thereon relative to the hair pickup elements 11 disposed on the fixed center piece 6. In a further feature of the invention, it is possible to provide for an individual relative rotation of all of the rings, the individual rings being then driven by means of gears coupled thereto.

In the cavity 5 between the inner shell 3 and the outer shell 1 an air-directing means is provided which serves the function of reducing the discharge velocity of the air stream without reducing the rate of air flow or increasing the resistance to flow. Air dispersed over the entire inner shell is expelled through the air discharge apertures 12 as well as through the apertures 48 at the upper ends of the hair pickup elements 9, 10, 11.

As becomes apparent from FIGS. 5 and 6, additional disks 18 rotating each about an axis of their own are arranged on the inner shell 3. Mounted on these disks are hair pickup elements 9, 10, and the number of in particular the hair pickup elements 9 may be variable, being however preferably in the range of between 2 and 5. The disks 18 are received in depressions 16 formed in the inner shell 3. The depressions 16 have apertures 17 encompassed by cylindrical sections 21. The disks 18 are provided with axles 19 extending through the cylindrical sections 21 into the cavity 5 and having a respective gear 20 at their inner ends. In the circumferential outer area between the shells 1 and 3, a rotary device 24 is disposed which has an angular, for example, T- or L-shaped cross-section. One leg 22 thereof is provided with internal teeth 23 meshing with the teeth of the gear 20. As the rotary device 24 is operated, this motion is transmitted through the gear 20 to the disks 18. The possibility exists also to alternate rotary disks with fixed disks 18, which is accomplished by securely clamping the fixed disks 18 in the cylindrical section 21 and omitting the gear 20 thereon.

FIGS. 7 and 8 illustrate a further embodiment of a diffuser in which the disks 18 carry further disks 26 each of which is rotary about its own axis. To prevent hair from being caught between the inner shell 3 and the disks 18, the disks 18 rest in depressions 16. Further depressions 25 are formed in the disks 18 in which the disks 26 are received. The disks 26 are rotatably mounted within the disks 18 by means of an axle 27. The disks 26 have teeth on their periphery. The disks 18 have a rim 28 provided with internal teeth which are in meshing engagement with the teeth on the disks 26. When the rotary device 24 is operated, setting the disk 18 in motion, the internal teeth on the rim 28 will mesh with the toothed outer rim 29 of the disks 26, thereby driving the disks 26 and causing the hair pickup elements 9 on the individual disks to be moved relative to each other.

Figure 11:
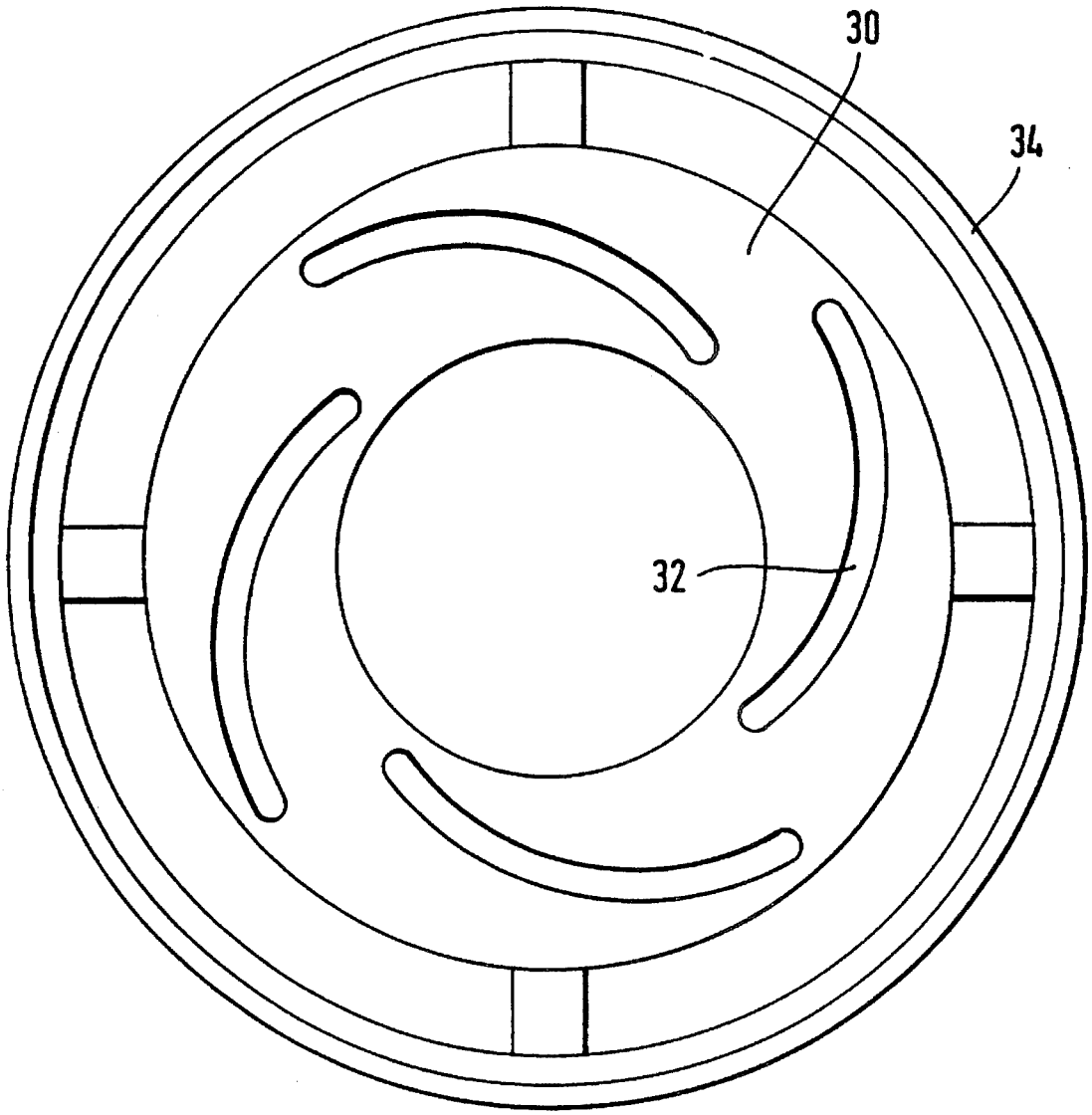
FIG. 11 is a top plan view of a rotary disk of FIG. 10, showing arc-shaped cutouts.

In FIGS. 9, 10 and 11 a diffuser is shown having hair pickup elements 9 which are movable radially to the central axis of the diffuser. These hair pickup elements 9 are disposed on bars 36. These bars are again held in apertured guideways arranged on the inner shell 3. A rotary disk 30 is provided between the outer shell 1 and the inner shell 3 of the diffuser, said disk having arc-shaped cutouts 32 ascending towards the periphery of the disk and descending at the other end. These cutouts 32 are engaged by the pins 37 of the bars 36. When the rim of the disk 30 configured as an actuating ring 34 is rotated, the pins 37 are guided within the arc-shaped cutouts 32, causing the bars 36 to move in a direction radial to the central axis of the diffuser. Rows with fixed hair pickup elements 10 are provided between the movable bars 36 carrying the hair pickup elements 9. The movement of the hair pickup elements 9 in a radial direction and thus relative to the hair pickup elements 10 provides added versatility in styling hair individually using this diffuser.

Figure 12:
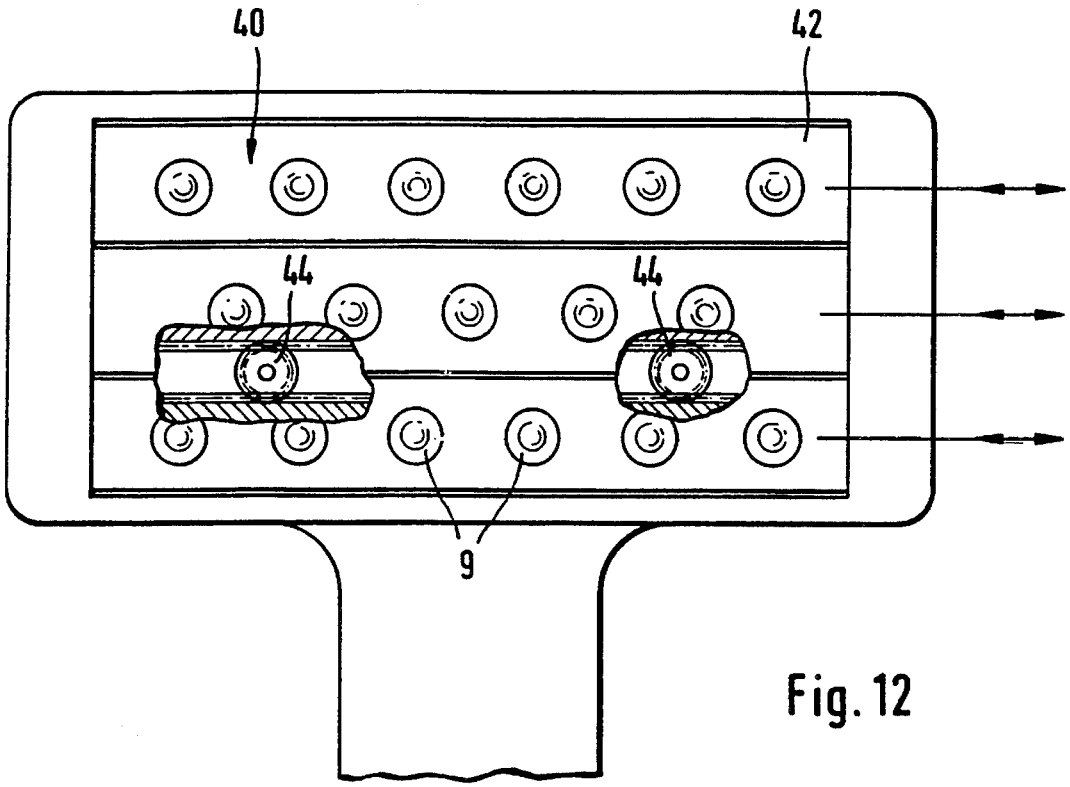
FIG. 12 is a front view, partially in section, of a diffuser illustrating a sixth embodiment thereof, showing hair pickup elements relatively movable in a linear direction.
Figure 13:
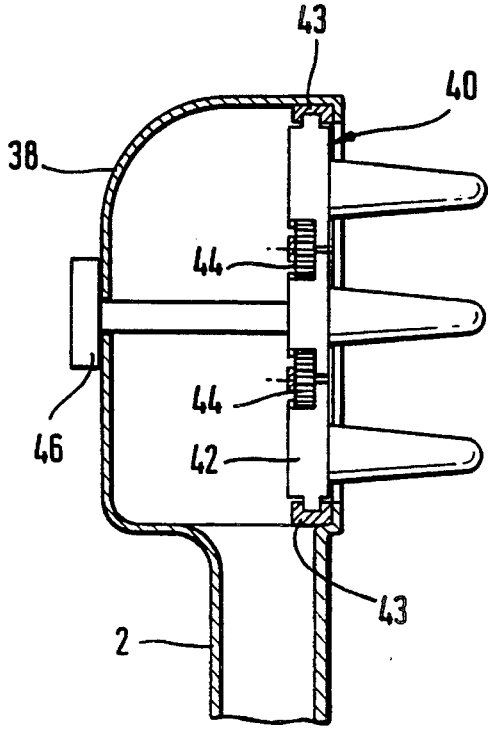
FIG. 13 is a schematic longitudinal sectional view of the diffuser of FIG. 12.

FIGS. 12 and 13 show a diffuser having an outer shell 38 and an inner shell 40 of a rectangular circumference. The inner shell 40 is formed with individual bars 42 and lateral guideways 43. The bars 42 lie directly adjacent to each other, their lower area providing however toothed racks guided on an underside of the inner shell 40. Between the individual bars 42, gears 44, at least one gear 44, are arranged for engagement with the racks. On the outer shell 38 an adjusting means 46 is provided which is coupled to one of the bars 42 and is movable linearly. When this bar 42 is moved by the adjusting means 46, the toothed rack formed on the bar 36 drives at least one gear 44 which in turn drives the next bar 36, resulting in linear displacement of the bars 36 in opposite directions. As a result, the hair pickup elements 9 disposed on the bars are moved away from each other, and sections of hair caught between the hair pickup elements 9 are thus formed in S-shape and fixed in this position as they dry, resulting necessarily in waves or curls. The number of the waves or curls can be varied in accordance with the user's needs, depending on the number of bars 36 and the number of hair pickup elements 9 which they carry.

We claim:

1. A diffuser for a hair drier comprising a diffuser body which is adapted to be secured to a nozzle of the hair dryer and includes a plurality of hair pickup elements extending away from the diffuser body, wherein at least one of the hair pickup elements is movably arranged on the diffuser body so as to be movable relative to others of said pickup elements from a first position to a selected spatially separated second position.

2. A diffuser as claimed in claim 1 wherein said plurality of pickup elements includes a first cluster of hair pickup elements and a second cluster of hair pickup elements and wherein the first cluster of hair pickup elements is fixedly secured to the diffuser body while the second cluster of hair pickup elements is movable relative to the first cluster of hair pickup elements.

3. A diffuser as claimed in claim 1 wherein all of the hair pickup elements are movable relative to each other.

4. A diffuser as claimed in claim 2 wherein the movement of at least one cluster of hair pickup elements is circular relative to a central axis of the diffuser.

5. A diffuser as claimed in claim 1 wherein the diffuser body comprises an outer shell and an inner shell rotatably mounted and secured within the outer shell

6. A diffuser as claimed in claim 5 further comprising a center piece connecting the inner shell to the outer shell, the inner shell being rotatable about a central axis of the diffuser and the center piece being secured to the outer shell through fastening apertures in the inner shell.

7. A diffuser as claimed in claim 6 wherein the outer shell, the inner shell and the center piece have an essentially circular circumference, wherein the fastening apertures provided in the inner shell are arc-shaped slotted holes, and wherein rotation of the inner shell is limited by the extent of said apertures.

8. A diffuser as claimed in claim 7 wherein the hair pickup elements are arranged on the diffuser body in an annular pattern.

9. A diffuser as claimed in claim 1 wherein individual clusters of hair pickup elements are movable in a circle about different axes of rotation related to each cluster.

10. A diffuser as claimed in claim 9 further comprising disks carrying said hair pickup elements and wherein the inner shell includes depressions with apertures in which the disks carrying said hair pickup elements are rotatably arranged.

11. A diffuser as claimed in claim 10 further comprising cylindrical sections encompassing the apertures and wherein each of the disks includes an axle with a gear, said axles being guided by the cylindrical sections encompassing the apertures.

12. A diffuser as claimed in claim 11 further comprising a rotary device disposed between a circumferential outer area of the inner and outer shells, said rotary device having an inwardly extending annular rim with internal teeth meshing with the gears in the interior of the diffuser.

13. A diffuser as claimed in claim 10 further comprising second disks carrying the hair pickup elements and wherein further depressions are provided on the first-mentioned disks, said further depressions rotatably receiving said second disks carrying the hair pickup elements.

14. A diffuser as claimed in claim 13 wherein each of the second disks is provided with a toothed outer rim and wherein each of the first mentioned disks has a rim with internal teeth which are adapted to drive said second disks.

15. A diffuser as claimed in claim 1 wherein individual clusters of the hair pickup elements are movable radially to the central axis of the diffuser.

16. A diffuser as claimed in claim 15 further comprising a disk and wherein the diffuser body comprises an outer shell and an inner shell, and wherein said disk is rotatably arranged between said inner and outer shells, said disk having arc-shaped cutouts ascending towards an outer edge of the disk and descending at the other end, and said disk having a rim configured as an actuating ring.

17. A diffuser as claimed in claim 16 or claim 16 further comprising bars carrying some of the hair pickup elements and wherein the inner shell comprises radial guideways having apertures in which said bars are received, with rows of hair pickup elements being fixedly secured in place between said bars on said inner shell.

18. A diffuser as claimed in claim 17 further comprising pins on the bars, wherein said pins engage within the arc-shaped cutouts, and wherein the bars are radially displaceable by means of the actuating ring.

19. A diffuser as claimed in claim 1 wherein individual clusters of hair pickup elements are movable linearly and in relatively opposite directions.

20. A diffuser as claimed in claim 19 further comprising individual bars carrying the hair pickup elements and lateral guideways guiding the individual bars and wherein the diffuser body has an outer circumference that is essentially rectangular, and the inner shell is formed by the individual bars carrying hair pickup elements and the lateral guideways.

21. A diffuser as claimed in claim 20 further comprising gears and wherein the individual bars are configured as toothed racks guided on an underside of the inner shell, said bars meshing with at least one of said gears arranged therebetween.

22. A diffuser as claimed in claim 20 or 21 further comprising adjusting means arranged on the outer shell and coupled to one end of the bars and wherein the bars are movable by said adjusting means.

23. A diffuser as claimed in wherein the hair pickup elements are selected from a group of objects consisting of knobs, fingers, prongs, and pins.

24. A diffuser as claimed in claim 1 wherein the hair pickup elements are hollow inside, having at their upper ends at least one laterally arranged aperture.

25. A diffuser as claimed in claim 1 wherein it is integrally formed with the hair dryer.

26. A diffuser for a hair dryer comprising a diffuser body which is adapted to be secured to a nozzle of the hair dryer and includes a plurality of hair pickup elements extending away from the diffuser body, said plurality of hair pickup elements including a first cluster of hair pickup elements and a second cluster of hair pickup elements, wherein said first cluster of hair pickup elements is movably arranged on the diffuser body so as to be movable relative to the second cluster of pickup elements from a first position to a selected, spatially separated second position.

27. A diffuser as claimed in claim 26, wherein the movement of at least one cluster is circular relative to a central axis of the diffuser.

28. A method of styling the hair of a user comprising the steps of:

providing, on an implement for styling hair of an air moving appliance for personal use, a body including a plurality of air exit apertures and carrying a plurality of hair pickup elements having distal ends extending away from the body, wherein at least one of the hair pickup elements is movably arranged on the body so as to be displaceable relative to others of the hair pickup elements from a first position to a selected spatially separated second position;

contacting the distal ends of the at least one of the hair pickup elements with the scalp of the user;

displacing the at least one of the hair pickup elements from the first position to the second position; and moving the hair between the displaced one of the hair pickup elements and the others of the hair pickup elements, whereby a flow of air exiting the air exit apertures dries the moved hair.

29. The method of claim 28, wherein the step of providing further comprises the hair pickup elements including a first cluster of hair pickup elements and a second cluster of hair pickup elements, wherein the first cluster of hair pickup elements is movably arranged on the body so as to be movable relative to the second cluster of hair pickup elements.

30. The method of claim 28, wherein the step of displacing further comprises the step of rotating the at least one hair pickup element about an axis through the body from the first position to the second position.

31. A diffuser as claimed in claim 1 in combination with the hair dryer.

32. A diffuser as claimed in claim 26 in combination with the hair dryer.

* * * * *

UNITED STATES PATENT AND TRADEMARK OFFICE

CERTIFICATE OF CORRECTION

PATENT NO. : 5,488,783

DATED : February 6, 1996

INVENTOR(S) : James W. Parkinson
Dieter Liebenthal

It is certified that error appears in the above-indentified patent and that said Letters Patent is hereby corrected as shown below:

In claim 17, first line, change "16" first occurrence to --15--; and in claim 23, first line, after "claimed in", insert --claim 1--.

Signed and Sealed this

Nineteenth Day of August, 1997

*Attest:*

*Attesting Officer*

BRUCE LEHMAN

*Commissioner of Patents and Trademarks*